United States Patent [19]

Dillon et al.

[11] Patent Number: 4,851,659

[45] Date of Patent: Jul. 25, 1989

[54] HIGH SPATIAL RESOLUTION 2-D BISTABLE LIGHT MODULATOR

[75] Inventors: Robert F. Dillon, Stoneham; Cardinal Warde, Newtonville, both of Mass.

[73] Assignee: Optron Systems, Inc., Bedford, Mass.

[21] Appl. No.: 15,055

[22] Filed: Feb. 17, 1987

[51] Int. Cl.[4] ..... H01J 40/14

[52] U.S. Cl. ..... 250/213 VT; 313/105 CM

[58] Field of Search ..... 250/213 VT, 213 R; 313/103 CM, 105 CM, 334

[56] References Cited

U.S. PATENT DOCUMENTS

| | | | |
|---|---|---|---|
| 2,892,095 | 6/1959 | Orthuber et al. | 250/213 R |
| 2,919,352 | 12/1959 | Kazan | 250/213 R |
| 2,975,291 | 3/1961 | Loebner et al. | 250/213 R |
| 3,054,900 | 9/1962 | Orthuber | 250/213 R |
| 3,059,118 | 10/1962 | Koury | 250/213 R |
| 3,171,965 | 3/1965 | Mc Naney | 250/213 R |
| 3,369,125 | 2/1968 | Dueker | 250/213 R |

OTHER PUBLICATIONS

Porada et al; Thin Film PC-EL System as Optoelectronic Logical Gate, Jan. 23-24, 1986.

Porada et al; Dynamic Characteristics of a Thin-Film Light Amplifier, Thin Solid Films, vol. 71, 1980, pp. 209-213.

Sharfin et al; Room-Temperature Optical Bistability in InGaAsP/InP Amplifiers and Implications for Passive Devices, Appl. Phys. Lett. 46(9), pp. 819-821, May 1985.

Gibbs et al; Nonlinear Etalons and Optical Computing, Univ. of Arizona, pp. 1-9.

Technology Trends, Photonics and Spectra, May 1982.

Miller et al; The Quantum Well Self-Electrooptic Effect Device; Optoelectronic Bistability and Oscillation, and Self-Linearized Modulation, IEEE J. of Quantum Electronics, vol. QE-21, No. 9, Sep., pp. 1462-1475.

Image storage with Optical Feedback Reference, by Nichol; *Photoelectronic Materials and Devices,* ED. Simon Larach, D. Van Nostrand Co., Princeton, N.J., pp. 355-361 (1965).

Hook; Optical Feedback Type Storage Light Intensifiers, RCA review, pp. 744-752, Dec. 1959.

Solid-State Optoelectronics, RCA Review, pp. 724-727, Dec. 1959.

Warde et al; High-Gamma Spatial Light Modulator for Nonlinear Optical Processing, Proceeding of the SPIE, vol. 613, pp. 255-259, 1986.

*Primary Examiner*—David C. Nelms

*Assistant Examiner*—Stephone B. Allen

*Attorney, Agent, or Firm*—Weingarten, Schurgin, Gagnebin & Hayes

[57] ABSTRACT

In one voltage-driven embodiment, a high spatial resolution two-dimensional array of bistable completely cross-talk free light modulation elements is constituted as a lamination of an input two-dimensional photoconductor thin film layer and an output two-dimensional electroluminescent phosphor thin film layer disposed in etched wells individually defined in corresponding cores of the optical fibers of a fiber optic face plate. In another voltage-driven embodiment, a very low cost high spatial resolution 2-D array of bistable substantially cross-talk free light modulation elements is constituted as a lamination of a photoconductor thin film layer, a selectively dimensioned and apertured opaque masking thin film layer, and an electroluminescent phosphor thin film layer. In an electron-driven embodiment, a high spatial resolution two-dimensional array of substantially cross-talk free bistable light modulating elements is constituted as an assembly of a two-dimensional input window having a deposited photocathode thin film layer, a two-dimensional output window having a deposited cathodoluminescent phosphor, and a two-dimensional glass capillary array defining plural charge feed forward and light feedback channels mounted therebetween in a vacuum tight enclosure. In a further electron driven embodiment, a microchannel plate subassembly is mounted in the vacuum-tight enclosure in the place of the glass capillary array. In the several embodiments, voltages are applied via transparent conductors to the photoconductor and phosphor layers.

10 Claims, 3 Drawing Sheets

HIGH SPATIAL RESOLUTION 2-D BISTABLE LIGHT MODULATOR

This invention was made with Government support under Contract N0014-86-C-0806 awarded by the Department of the Navy. The government has certain rights in the invention.

FIELD OF THE INVENTION

The instant invention is directed to the field of optical signal processing, and more particularly, to a novel high spatial resolution two-dimensional bistable light modulator.

BACKGROUND OF THE INVENTION

In many applications it is desirable to so modulate the spatially varying intensity of an input two dimensional optical signal as to provide a two dimensional output signal defining a two valued spatially varying state distribution in conformance with the way the intensity of the input two dimensional signal is spatially distributed above or below a selectable threshold intensity. Where 2-D imaging quality is important, the modulators are further called upon to provide a high spatial resolution. The modulators should in addition be able to be fabricated at reasonably low-cost and in such a way that the resolution of the device is not subject to degradation by manufacturing and materials irregularities. Power consumption, and therewith heat radiation, should be as low as possible to enable, among other things, scalability to any intended device size. Switching speeds between states should be relatively high, so that the device can provide a high information handling rate. Sensitivity to low intensity input signal levels and high optical gains should be selectively available, and, among other things, the modulator should provide long-term and readily erasable latching, be operable at room temperatures, and be completely cascadable with other subsystems. The heretofore known devices and technologies have been deficient in one or more of the foregoing and other aspects.

SUMMARY OF THE INVENTION

The high spatial resolution 2-D bistable light modulator of the present invention contemplates as one of its principal objects a comparatively low-cost integrated two dimensional assembly of plural, spatially proximate, and substantially cross-talk free light modulating elements cooperative to provide one of two luminescent output states in response to the intensity of an input electromagnetic signal in such a way that the spatial distribution of the different luminescent states corresponds with the way the intensity of the input two dimensional signal spatially varies above and below a selectable intensity value. The ON output level is always significantly higher than the corresponding above-threshold input level so that these devices exhibit optical gain. In one voltage-driven embodiment, a high spatial resolution two dimensional array of bistable completely cross-talk free light modulation elements is constituted as a lamination of an input two-dimensional photoconductor thin film layer and an output two dimensional electroluminescent phosphor thin film layer disposed in etched wells individually defined in corresponding cores of the optical fibers of a fiber optic face plate. A DC or slowly varying AC source is connected to transparent planar electrodes respectively provided over the exposed face of the photoconductor thin film layer and over the exposed face of the electrophosphor thin film layer for providing a longitudinally directed E-field across the plural cross-talk free light modulating elements in parallel. In another voltage-driven embodiment, a very low cost high spatial resolution 2-D array of bistable substantially cross-talk free light modulation elements is constituted as a lamination of a photoconductor thin film layer, a selectively dimensioned and apertured opaque masking thin film layer, and an electroluminescent phosphor thin film layer. The lamination is sandwiched between planar transparent electrodes deposited on transparent substrates. The assembly is maintained in a hermetic sealing relationship. A voltage source electrically connected between the transparent planar electrodes is provided for establishing a longitudinally extending E-field therebetween. The dimensions of the apertured opaque mask are selected to provide plural bistable light modulation elements with an intended spatial resolution and level of cross-talk. In an electron-driven embodiment, a high spatial resolution two dimensional array of substantially cross-talk free bistable light modulating elements is constituted as an assembly of a two dimensional input window having a deposited photocathode thin film layer, a two dimensional output window having a deposited cathodoluminescent phosphor, and a two dimensional glass capillary array mounted therebetween in a vacuum tight enclosure. The several pores of the glass capillary array provide substantially cross-talk free charge feedforward and light feedback channels. Transparent planar electrodes are respectively provided on the two dimensional input and output faces, and a voltage source is connected between the 2-D transparent planar electrodes so as to provide a proximity focusing E-field therebetween. In a further electron-driven embodiment, a microchannel plate subassembly is mounted in the vacuum-tight enclosure in the place of the glass capillary array. The several amplification channels of the microchannel plate subassembly constitute high-gain substantially cross-talk free charge feedforward and light feedback channels. In each of the several embodiments, the input two dimensional signal is either coherent or incoherent light and the output two dimensional signal either is poly or substantially monochromatic light. In each of the several embodiments, above a certain selectable threshold intensity level of the 2-D input signal, self-sustaining feedback excitation of the phosphor layer locally corresponding to the local input intensity occurs, and in such a way that the corresponding light modulation elements are thereby latched into and remain in the excited state, independently of the intensity of the input two dimensional signal. In each of the devices the latched ON state is at a higher intensity level than the corresponding input, so that the devices exhibit optical gain. Erasure, in any of the embodiments, is readily accomplished by merely interrupting the drive source. The embodiments severally exhibit high temporal bandwidth cycling, an excellent imaging capability, low-cost producibility, uniform device performance over a range of dimensional scales, sensitivity to low-level input intensities, room-temperature operation, and, among other advantages, system-integrability and cascadability.

BRIEF DESCRIPTION OF THE DRAWINGS

These and other aspects, objects and advantages will appear as the invention becomes better understood by referring to the following solely exemplary detailed description of the preferred embodiments thereof, and to the drawings, wherein.

DETAILED DESCRIPTION OF THE INVENTION

A "modulator" as herein used designates devices operative to provide a control function on an input light beam in such a way that an output beam is produced according to the control function of the device, where the control function particularly designates a thresholding function.

The term "light" in reference to the input signal herein designates electromagnetic energy either in or outside the visible region of the spectrum.

The term "bistable" designates that the intensity of the luminescence of the output beam is able to stably exist in either of two different states, namely an "on" and an "off" state.

The phrase "high spatial resolution two dimensional" designates the capability to selectably provide high quality imaging of input two dimensional electromagnetic signals.

Figure 1:
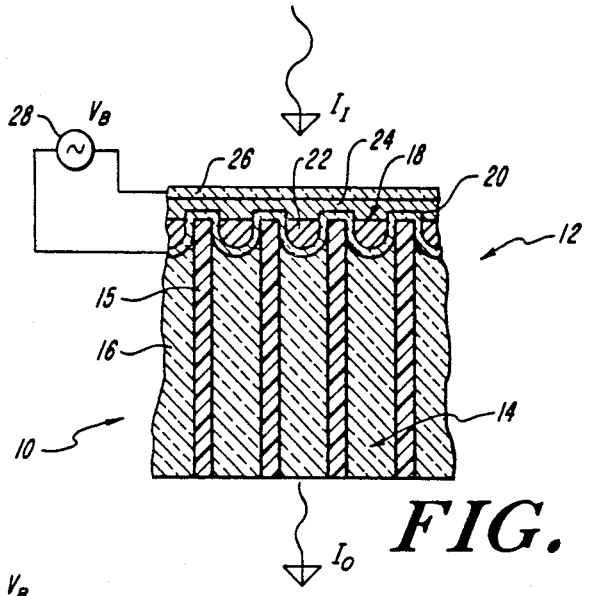
FIG. 1 is a partially pictorial partially sectional diagram illustrating one voltage driven embodiment of the high resolution two dimensional bistable light modulator according to the present invention.

Referring now to FIG. 1, generally designated at 10 is a pictorial view illustrating a first embodiment of a high spatial resolution two dimensional bistable light modulator according to the present invention. The modulator 10 includes a substrate generally designated 12 consisting of a conventional fiber optic face plate. The substrate 12 provides a structure upon an end face of which is provided a low cost integrated two dimensional assembly of plural spatially proximate and completely cross-talk free light modulating elements to be described. The substrate 12 additionally provides a high efficiency optical coupler, that is readily connectable with other components, not shown, of an optical system.

The fiber optic face plate includes a 2-D array of longitudinally extending optical fibers generally designated 14. The fibers 14 are severally constituted by an optically opaque cladding member 15 surrounding a light transmissive core member 16. By way of example, but not limitation, a circular substrate 12 of a 25 millimeter diameter can have approximately one million elements on 25 micron centers.

Wells generally designated 18 are etched into or otherwise formed in the cores 16 at the ends of each of the optical fibers 14 of the fiber optic face plate 12. The wells 18 formed in the associated cores 16 of the optical fibers 14 provide a very high light collection efficiency. The opaque claddings 15 completely isolate spatially adjacent wells from optically intercoupling, thereby providing completely cross-talk free channels.

A transparent conductor 20 is provided as a thin film layer over the exposed face of the substrate 12 into which the plural wells 18 have been fabricated. The transparent conductor 20 tracks the "dimpled" contour of the etched face of the face plate and overlays the interfiber cladding members 15 and the core members 16 without thereby completely filling the wells 18. Any suitable transparent conductor may be used, for example, indium tin oxide (ITO). The conductor layer may be flash deposited, sputter deposited, or sprayed on, among others, without departing from the inventive concept.

Discrete pads 22 of an electroluminescent phosphor are provided in corresponding ones of the wells 18. The pads 22, insofar as they are wholly received within the associated wells, are completely free from optical cross-talk. Exemplary electroluminescent phosphors include copper and manganese activated zinc sulfide.

The electroluminescent phospor may be painted as a powder into the several wells, evaporated therein, and sputter deposited, among other application techniques, without departing from the inventive concept. A two dimensional photoconductor layer 24 is provided as a thin film over the several pads 22 and the exposed confronting surfaces of the transparent conductor 20 along the etched face of the face plate 12. The electroluminescent phosphor pads 22 each mechanically and electrically contact the confronting surface of the photoconductor 24 in the several wells 18. Any suitable photoconductor such as CdS, Se, PVK/TNF may advantageously be employed. The thickness dimension of the photoconductor thin film layer is selected to tune the device to an intended input signal intensity threshold value. Any suitable technique, such as sputtering, for example, may be employed to deposit the photoconductor thin film layer.

A transparent conductor 26 is provided as a thin film over the photoconductor 24. The conductor 26 is deposited, as is the transparent conductor 20, by sputtering, evaporation, or spray-on technology, among others, well known to those skilled in the art, and the transparent conductor 26 may, like the conductor 20, for example, be indium tin oxide (ITO). A voltage source 28, designated "$V_B$", which may either be DC or be low-frequency unipolar AC, is electrically connected between the transparent planar electrodes 20, 26. The source 28 provides a longitudinally extending E-field for driving the several photoconductor/phosphor laminations of the plural cross-talk free light modulation elements in parallel. The assembly 10 is preferably mounted in an air-tight enclosure, not shown.

Figure 2:
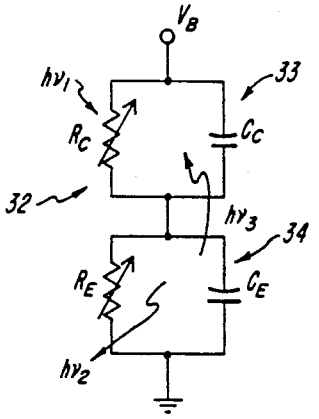
FIG. 2 is a circuit diagram illustrating one of the bistable light modulation elements of the FIG. 1 embodiment.

Referring now to FIG. 2, generally designated at 32 is an electrical diagram of one bistable light modulation element of the voltage-driven modulator of FIG. 1. Each photoconductor/electroluminescent phosphor lamination is schematically represented by a parallel resistor/capacitor network 33 designated "$R_c$, $C_c$" that is in series with a parallel resistor/capacitor network 34 designated "$R_E$, $C_E$", where "$R_c$" represents the variable photoconductor resistance, "$C_c$" represents the photoconductor capacitance, "$R_E$" represents the variable electrophosphor resistance and "$C_E$" represents the capacitance of the phosphor.

In the preferred embodiment, the photoconductive thin film layer is selected to have such a thickness dimension that the capacitance of the photoconductor, $C_c$, is much smaller than that of the electroluminescent phosphor, $C_e$, and that the dark resistance of the photoconductor, $R_{cd}$, is greater than the resistance of the phosphor, $R_e$. With no input signal (designated "$I_f$" in FIG. 1) illuminating the photoconductor, the capacitances of the phosphor and of the photoconductor present open circuits, so that the drive voltage, $V_b$, divides resistively across the dark resistance of the photoconductor, $R_{cd}$, and the resistance of the phosphor, $R_e$, in such a way that the voltage drop across the photoconductor, $V_c$, is greater than the voltage drop across the phsophor, $V_e$. For the exemplary input intensity and bias voltage, $V_b$, the voltage across the phosphor, $V_e$, is below the luminescence threshold of the particular phosphor selected, and no light is generated by the phosphor.

As the intensity of the input illumination, "$h\nu_1$" on the photoconductive layer increases, the resistance of the photoconductor locally decreases, causing a greater percentage of the applied voltage to fall across the electroluminescent phosphor. When the input illumination intensity rises above the selected threshold level, the resulting increased field strength stimulates the phosphor to emit photons, designated "$h\nu_2$". A part of the light emission from the phosphor, "$h\nu_3$", feeds back to the photoconductor, so that the resistance of the photoconductor is further reduced thereby, and the voltage across the phosphor therewith increases. Beyond a selectable threshold value of the input intensity, the phosphor is driven into the fully-on condition, where the intensity of the output emission from the phosphor does not increase, because the voltage drop across the phosphor, $V_e$, is that of the drive voltage source, $V_b$. Thereafter, the light emission of the excited phosphor is self-sustaining, and the associated light modulating element is latched in the "on" state irrespective of the value of the input intensity of the two dimensional input beam.

Figure 3:
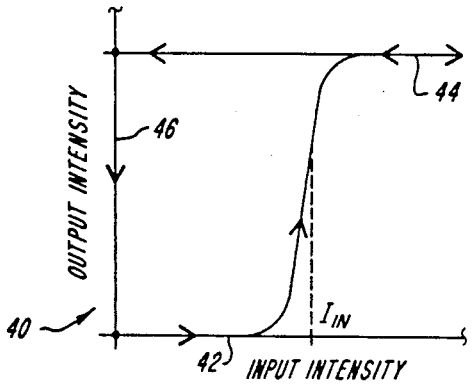
FIG. 3 is a graph useful in explaining the bistability characteristic exhibited by the FIG. 1 embodiment.

Referring now to FIG. 3, generally designated at 40 is a graph illustrating the optical bistability characteristic exhibited by each light modulating element of the present invention. The abscissa represents the intensity incident on the photoconductor, and the ordinate represents the output intensity of the phosphor. As shown by a curve section 42, each light modulating element exhibits a so-called "gray" behavior mode, such that the output intensity varies with the intensity of the input and both increases and decreases proportionately as the intensity of the input becomes more and less bright.

As shown by a curve portion 44, once the input intensity is locally above a threshold value, designated by a dashed line "$I_{TH}$", the output intensity rapidly ramps to a quiescent value and latches in the fully-on condition. As illustrated, once in the fully-on condition, the output intensity is independent of the further history of non-zero values of the input intensity. The elements are turned-off, as shown by a curve portion 46, simply by interrupting the voltage source, $V_b$.

Figure 4:
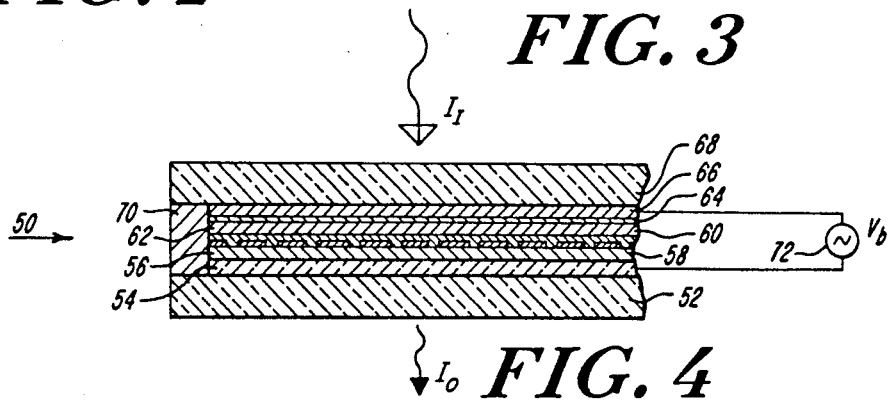
FIG. 4 is a partially pictorial, partially sectional diagram illustrating another voltage driven embodiment of the high resolution two dimensional bistable light modulator according to the present invention.

Referring now to FIG. 4, generally designated at 50 is a partially pictorial partially sectional diagram illustrating a further voltage-driven embodiment of the high spatial resolution two dimensional bistable light modulator according to the present invention. In this embodiment, an integrated two dimensional assembly of plural spatially proximate and substantially cross-talk free light modulating elements is fabricated upon a planar substrate 52. The substrate 52 can be any suitable transparent substrate such as glass or a flexible transparent material such as plastic or acetate mylar in the case of a mechanically flexible bistable optical device.

Figure 5:
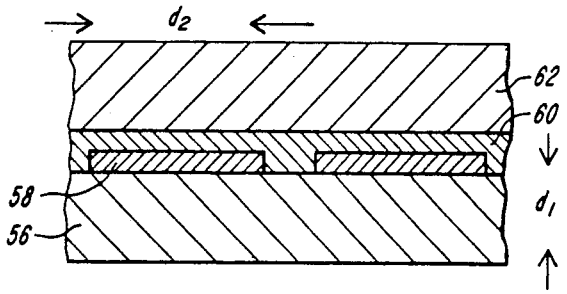
FIG. 5 is a fragmentary and enlarged schematic diagram illustrating a component of the embodiment of FIG. 4.

A transparent planar conductor 54, such as indium tin oxide, is evaporated or otherwise deposited on a face of the substrate 52. A two dimensional electroluminescent phosphor thin film layer 56, such as copper and manganese activated zinc sulfide, is, for example, evaporated as a thin film on the transparent planar conductor 54. An apertured opaque mask generally designated 58, such as a screened opaque ink, is overlayed on the two dimensional phosphor 56. The thickness dimension of the phosphor layer and the dimensions and spacing of the apertures of the opaque mask 58 are selected such that the modulator has an intended 2-D spatial resolution and an intended degree of cross-talk. In the presently preferred embodiment as best seen in FIG. 5, the thickness designated "$d_1$" of the phosphor 56 is selected to be relatively thin compared to the dimension of the opaque region "$d_2$" of the mask 58. Optical isolation is not complete, but for many low-cost applications, the channels are substantially cross-talk free for a given 2-D spatial resolution. Optical bistability exists in the region of the interspaces of the apertured mask. For an input light pulse wider than the interspace, for example, the phosphor is "lit" in regions thereof subjacent the opaque portions of the mask. When the pulse is terminated, the light, only fed back through the openings of the mask, sustains the confronting region of the photoconductor in the "on" condition, namely in the region of the interspaces of the mask.

A sealer coating 60 of a transparent, non-conducting material is deposited on the opaque mask 58 to prevent chemical destruction. An input two dimensional photoconductor 62 is deposited on the coating 60. The photoconductor 62 may be CdS, Se, PVK/TNF, and may be flash evaporated thereonto as a thin film. A high dielectric strength coating 64, for example paralene, is deposited, as by evaporation, over the photoconductor 62 to prevent electrical arcing. A planar transparent conductor 66, such as indium tin oxide, is, for example, flash evaporated onto the photoconductor 62. A transparent substrate 68, such as glass, or plastic or mylar for flexible devices, is provided as a two dimensional input window. Seals 70 are provided between the substrates 52, 68 to vacuum seal the assembly against the atmosphere.

A voltage source 72, designated "$V_b$", is operatively connected to the electrodes 54, 66. The voltage source preferably is either a DC source or a low-frequency unipolar AC source.

The operation of the light modulating elements of the FIGS. 4 and 5 embodiment of the high spatial resolution two dimensional bistable light modulator of the present invention is substantially the same as the operation of the embodiment described above in connection with the description of FIGS. 1–3, and is not repeatedly explained for conciseness of description.

Figure 6:
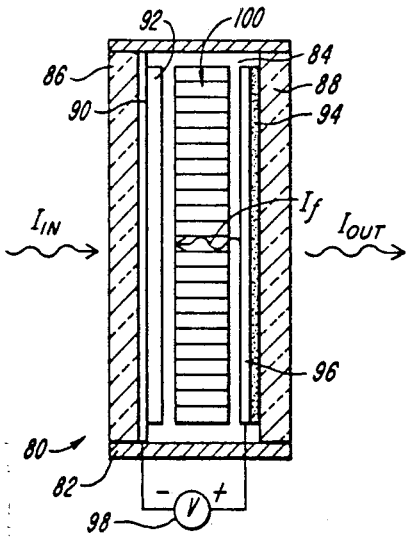
FIG. 6 is a partially pictorial, partially sectional diagram illustrating an electron-driven embodiment of the high spatial resolution two dimensional bistable light modulator according to the present invention.

Referring now to FIG. 6, generally designated at 80 is an electron-driven embodiment of the high spatial resolution two dimensional bistable light modulator according to the present invention. The modulator 80 includes an enclosure 82 defining a vacuum generally designated 84. Two dimensional windows 86, 88 of a light transmissive material are provided on opposing sides of the enclosure 82. Fiber-optic face plates may be used for these windows. A two dimensional transparent conductor 90, such as indium-tin oxide, is flash-evaporated or otherwise deposited on the inside face of the transparent window 86. An input two dimensional photocathode 92, such as an S-20, well known to those skilled in the art, is flash-evaporated or otherwise deposited as a thin-film on the vacuum face of the transparent conductor 90. An output two dimensional cathodoluminescent phosphor 94, such as P-46, is flash-evaporated or otherwise deposited as a thin-film on the vacuum face of the output window 88. A two dimensional transparent conductor 96, such as a thin layer of aluminum, is flash-evaporated or otherwise deposited on the phosphor layer 94. A partially transmissive conductive material, such as an aluminum layer, can be alternately employed, where it is desired to select the degree of optical feedback. A voltage source 98, $V_b$, is electrically connected between the conductors 90, 96. The voltage source establishes and maintains a longitudinally-extending proximity focusing E-field in the vacuum between the conductors 90, 96.

Figure 7:
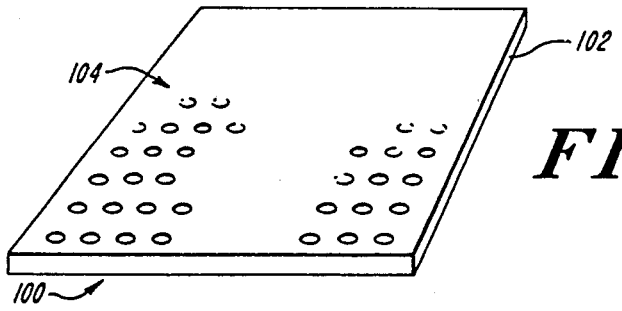
FIG. 7 is an isometric diagram illustrating a component of the embodiment of FIG. 6.

A glass capillary array generally designated 100, or other porous insulating member, is mounted in the vacuum enclosure 84 intermediate the photocathode 92 and the transparent conductor 96. As best seen in FIG. 7, the glass capillary array 100 is constituted as an apertured insulative plate 102 defining a high spatial resolution array of longitudinally extending channels therethrough generally designated 104.

In operation, the spatially varying intensity of the input light incident on the two dimensioal input photocathode causes the photocathode to locally emit electrons in proportion to the local intensity of the input light signal. The electrons, accelerated through the vacuum by the longitudinally extending E-field, enter the high spatial resolution electrically insulated and cross-talk free channels of the glass capillary array, and gain kinetic energy as they are accelerated therethrough in dependence on the voltage difference established in the vacuum by the voltage source. The energetic electrons have a number density distribution that matches the spatial intensity distribution of the 2-D input signal and are locally incident on the confronting surface of the two dimensional output phosphor. The intensity of the light emission in the phosphor depends on the kinetic energy and charge density of the locally incident electrons. For every electronvolt of energy, about 0.01 photon is emitted, so that for an exemplary 3 kiloelectronvolt accelerating potential difference, each incident electron excites the phosphor layer to emit approximately 30 photons.

Some of the photons are emitted by the phosphor as an output two dimensional beam, and others couple back through the confronting channels of the glass capillary array as 2-D optical feedback. The photons fed back further stimulate the photocathode to locally emit more electrons. The proximity focusing field accelerates these additional electrons and feeds them forward reciprocally back through the confronting channels, onto and further stimulating the local emission of the cathodoluminescent phosphor output layer.

Above a selectable input intensity of the two dimensional input signal, the charge fed forward and the photons fed back are such that the light emitted by the phosphor is sufficient to locally support self-sustaining light stimulation. The output phosphor then locally latches at a steady-state intensity in the fully "on" condition, and the output state is thereafter independent of the subsequent history of the input intensity of the two dimensional input signal. The output luminescence is latched at a steady state value due to charge transfer limitations in the photocathode, and due to equilibrium conditions in the cathodoluminescent phosphor. The light modulator 80 is erased simply by interrupting the supply voltage.

Figure 8:
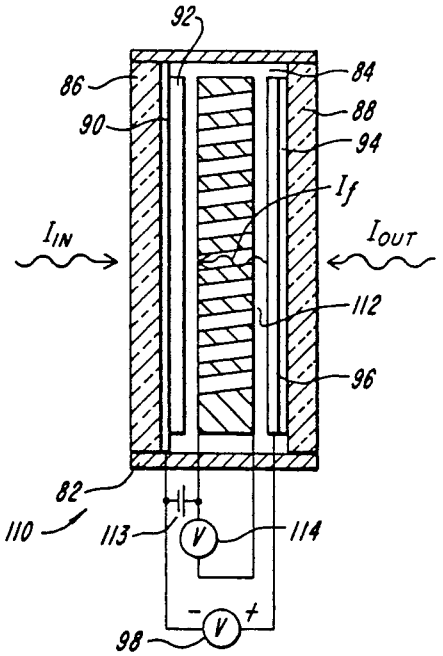
FIG. 8 is a partially pictorial, partially sectional diagram illustrating another electron-driven embodiment of the high spatial resolution two dimensional bistable light modulator of the instant invention.
Figure 9:
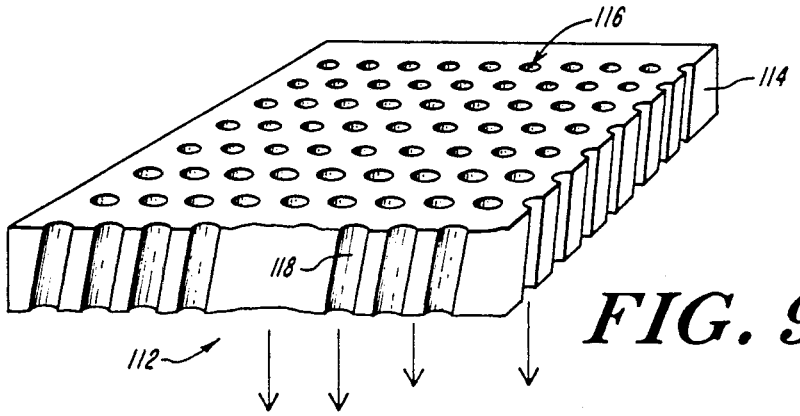
FIG. 9 is an isometric diagram illustrating a component of the embodiment of FIG. 8.

Referring now to FIG. 8, generally designated at 110 is a further electron-driven embodiment of the high spatial resolution two dimensional bistable light modulator according to the present invention. Elements of the modulator 110 that are the same as elements of the light modulator 80 of the FIGS. 6, 7 embodiment are similarly designated. The light modulator 110 principally differs from the light modulator 80 insofar as a microchannel plate subassembly generally designated 112 is mounted in the vacuum intermediate the photocathode and transparent electrode. A voltage source 114, $V_d$, is connected across the microchannel plate subassembly 112, and a voltage source 113 biases the input face of the microchannel plate positive with respect to the photocathode. As best seen in FIG. 9, the microchannel plate subassembly 112 includes a porous glass substrate 114 having an array of closely-spaced continuous dynodes generally designated 116 provided therethrough. Each dynode 116 includes a coating of a high secondary-electron emitting substance 118 disposed about its inside wall that is operative in response to electrons incident into the dynode to provide a multiple electron output out of the continuous dynode by a well-know avalanching process. The comparatively immense gains thereby available from the microchannel plate subassembly thereby provides the modulator with an ultra-low sensitivity to photon-limited input signals, so that local self-sustaining action is able to be initiated at room temperatures in response to only a few photons and at very high temporal bandwidths. Other MCP assemblies than the "slanted" pore configuration of course can be employed as well without departing from the inventive concept.

Figure 10:
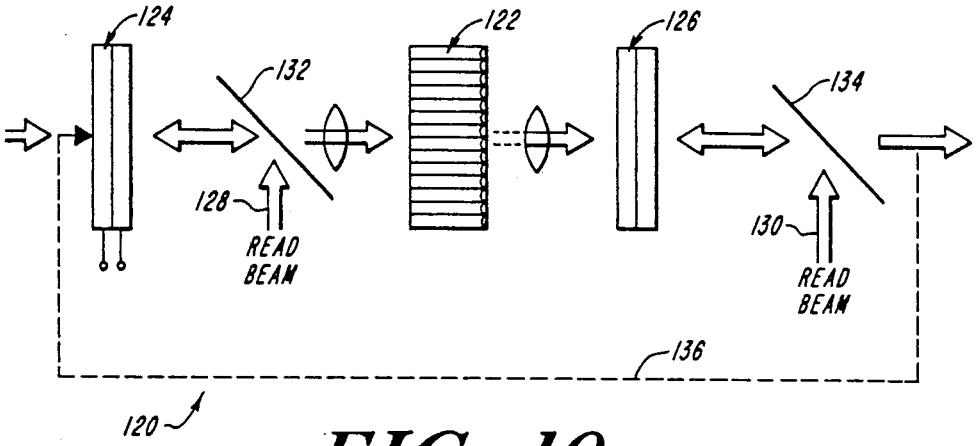
FIG. 10 is a schematic pictorial diagram illustrating an exemplary applications environment.

Referring now to FIG. 10, generally designated at 120 is an exemplary application for the high spatial resolution two dimensional bistable light modulator of any of the embodiments of the light modulator described above in connection with the description of FIGS. 1–9 according to the present invention. A bistable light modulator 122 is positioned along an optical path between a general input spatial light modulator device (e.g. a charge transfer signal processor) generally designated 124 and a general output spatial light modulator generally designated 126 such as an output charge transfer signal processor. The processors 124, 126 are responsive to the intensity distribution of the light at their input faces to provide an amplified electron charge density distribution that spatially varies in correspondence to the way the input intensity distribution spatially varies at their output faces. Exemplary charge transfer signal processors suitable as the elements 124, 126 are disclosed and claimed in co-pending U.S. utility patent application Ser. No. 840,684 of the same assignee as herein, incorporated herein by reference. The processor 124, may, for example, provide multiplication, contrast enhancement, contrast reversal, edge enhancement, etc.; the bistable modulator 122 may provide logic, non-linear switching, half-toning, etc.; and the processor 126 may provide multiplication, contrast enhancement, contrast reversal, edge enhancement, etc., of input 2-D electromagnetic signals. The processors 124, 126 are read, by read-out light beams 128, 130, that are deviated off the output faces of the modulators 124, 126 via respective beam splitters 132, 134. As schematically illustrated by a dashed line 136, the output of the downstream processor may be coupled back to the input of the upstream processor for operation in a closed-loop mode. The several stages are cascadable, and the illustrated application is exemplary only. Interstage optical coupling is illustrated in the figure, but, as will be appreciated, information transfer between stages can be accomplished directly as well.

Many modifications of the presently disclosed invention will become apparent to those skilled in the art without departing from the scope of the invention.

What is claimed is:

1. A substantially cross-talk free electron-driven high spatial resolution 2-dimensional bistable light modulator, comprising:

vacuum housing means defining spaced and confronting two-dimensional input and output ports providing an evacuated region between the input and output ports;

a two-dimensional photocathode layer mounted to the two-dimensional input port;

a two-dimensional cathodoluminescent phosphor layer mounted at the two-dimensional output port;

high spatial resolution means for providing a two-dimensional array of plural elongated mutually optically and electrically isolated charge feedforward and light feedback channels in said evacuated region intermediate said two-dimensional input and output ports of said vacuum housing means in such a way that the elongated channels define straight line paths intermediate said two-dimensional photocathode and phosphor layers; and means coupled to said photocathode layer and said cathodoluminescent phosphor layer for transferring charge from the two-dimensional photocathode layer through the high spatial resolution means in said evacuated region and for imaging the charge transferred therethrough onto the two-dimensioal phosphor layer.

2. The light modulator of claim 1, wherein said high spatial resolution means includes a glass capillary array.

3. The light modulator of claim 1, wherein said charge transfer and imaging means includes transparent planar conductors respectively adhered to said photoconductor and said phosphor layers, and a voltage source for providing a proximity-focusing and longitudinally extending E-field in the evacuated region.

4. The light modulator of claim 3, wherein said voltage source is a DC source.

5. The light modulator of claim 3, wherein said voltage source is a slowly varying AC source.

6. An ultra-high input sensitivity electron-driven high spatial resolution two-dimensional bistable light modulator, comprising:

vacuum housing means defining spaced and confronting two-dimensional input and output ports and providing an evacuated region between the input and output ports;

a two-dimensional photocathode layer mounted at the two-dimensional input port;

a two-dimensional cathodoluminescent phosphor layer mounted at the two-dimensional output port;

means for providing a two-dimensional high spatial resolution array of high-efficiency, secondary electron emitting dynodes that each define an electron amplification feedforward and a light feedback channel and that together are substantially cross-talk free; and means coupled to said photocathode layer and to said phosphor layer and cooperative with said dynode array providing means for transferring charge from the photocathode through the evacuated region and imaging it on the phosphor layer.

7. The light modulator of claim 6, wherein the dynode array providing means includes a microchannel plate subassembly.

8. The light modulator of claim 6, wherein said charge transfer and imaging means includes transparent planar conductors mounted to the photocathode layer and to the phosphor layer respectively for providing a longitudinally-extending proximity-focusing E-field in the evacuated region.

9. The light modulator of claim 8 wherein said voltage source includes a DC voltage source.

10. The light modulator of claim 8, wherein said voltage source includes a slowly varying AC voltage source.

* * * * *